US005877465A

United States Patent [19]

Perret

[11] Patent Number: 5,877,465

[45] Date of Patent: Mar. 2, 1999

[54] HIGH-TENSION CIRCUIT-BREAKER WITH DAMPER

[75] Inventor: Michel Perret, Bourgoin-Jallieu, France

[73] Assignee: GEC Alsthom T & D SA, Paris, France

[21] Appl. No.: 934,216

[22] Filed: Sep. 19, 1997

[30] Foreign Application Priority Data

Sep. 23, 1996 [FR] France ..... 96 11545

[51] Int. Cl.[6] ..... H01H 33/88

[52] U.S. Cl. ..... 218/60

[58] Field of Search ..... 218/43, 51, 52, 218/56, 57, 59–61, 66, 68, 78, 84–86, 88

[56] References Cited

U.S. PATENT DOCUMENTS

| | | | |
|---|---|---|---|
| 4,041,264 | 8/1977 | Grune | 200/148 R |
| 4,459,447 | 7/1984 | Arimoto | 200/148 A |
| 5,001,314 | 3/1991 | Thuries et al. | 200/148 B |
| 5,567,923 | 10/1996 | Perret | 218/60 |

FOREIGN PATENT DOCUMENTS

| | | | |
|---|---|---|---|
| 0508160A2 | 10/1992 | European Pat. Off. | H01H 33/91 |
| 844333 | 7/1952 | Germany . | |
| 1198908 | 8/1965 | Germany . | |
| 2943881 | 5/1980 | Germany | H01H 33/91 |
| 3104411A1 | 8/1982 | Germany | H01H 33/90 |

*Primary Examiner*—Michael A. Friedhofer
*Attorney, Agent, or Firm*—Sughrue, Mion, Zinn, Macpeak & Seas, PLLC

[57] ABSTRACT

A high-tension circuit-breaker includes fixed contacts and a mobile assembly including mobile contacts. The mobile assembly is connected to an operating mechanism by an operating rod. The circuit-breaker includes a device for damping movement of the rod at the end of a tripping maneuver. This device includes a damper piston entrained by movement of the rod at the end of the tripping maneuver and moving in a cylinder in one direction such that the volume between the piston and an end wall of the cylinder increases during the maneuver, causing a pressure drop in this volume.

3 Claims, 3 Drawing Sheets

HIGH-TENSION CIRCUIT-BREAKER WITH DAMPER

BACKGROUND OF THE INVENTION

1. Field of the Invention

The present invention concerns a high-tension circuit-breaker having an interrupter chamber filled with insulative gas in which are disposed a fixed assembly comprising contacts for the passage of the permanent current and arc contacts and a mobile assembly comprising contacts for the passage of the permanent current, arc contacts and a gas blast cylinder associated with a gas blast nozzle. The mobile assembly is connected to an operating mechanism by an insulative rod.

The mobile assembly has a relatively high total mass which, during an operation to open the circuit-breaker, is driven at high speed over a relatively short travel. The high speed is imposed by the need to extinguish the arc rapidly on the first zero-crossing of the current and to move the contacts quickly apart to avoid all risk of restriking of the arc.

It is essential for the movement of the mobile assembly to be damped at the end of its travel, failing which the pole may be damaged or premature wear may occur.

2. Description of the Prior Art

Most known circuit-breaker damper devices include a cylinder filled with gas compressed by a piston attached to the mobile assembly. In such systems, the damping force is low at the start of damping and becomes very high at the end of damping, which often causes the mobile contacts of the circuit-breaker to rebound.

One aim of the present invention is to provide a circuit-breaker in which the damping force is high from the very start of damping, without reaching a value that can cause rebound.

SUMMARY OF THE INVENTION

The present invention comprises a high-tension circuit-breaker including fixed contacts and a mobile assembly including mobile contacts, the mobile assembly being connected to an operating mechanism by an operating rod, the circuit-breaker including a device for damping movement of the rod at the end of a tripping maneuver, the device including a damper piston entrained by movement of the rod at the end of the tripping maneuver and moving in a cylinder in one direction such that the volume between the piston and an end wall of the cylinder increases during the maneuver, causing a pressure drop in the volume.

The damper piston advantageously uncovers holes providing communication between the volume at reduced pressure and the remainder of the chamber at the end of the tripping maneuver.

The damper piston compresses the volume placed in front of it during the tripping maneuver.

The invention will be better understood from a reading of the following description given with reference to the accompanying drawing.

DETAILED DESCRIPTION OF THE PREFERRED EMBODIMENT

Figure 1:
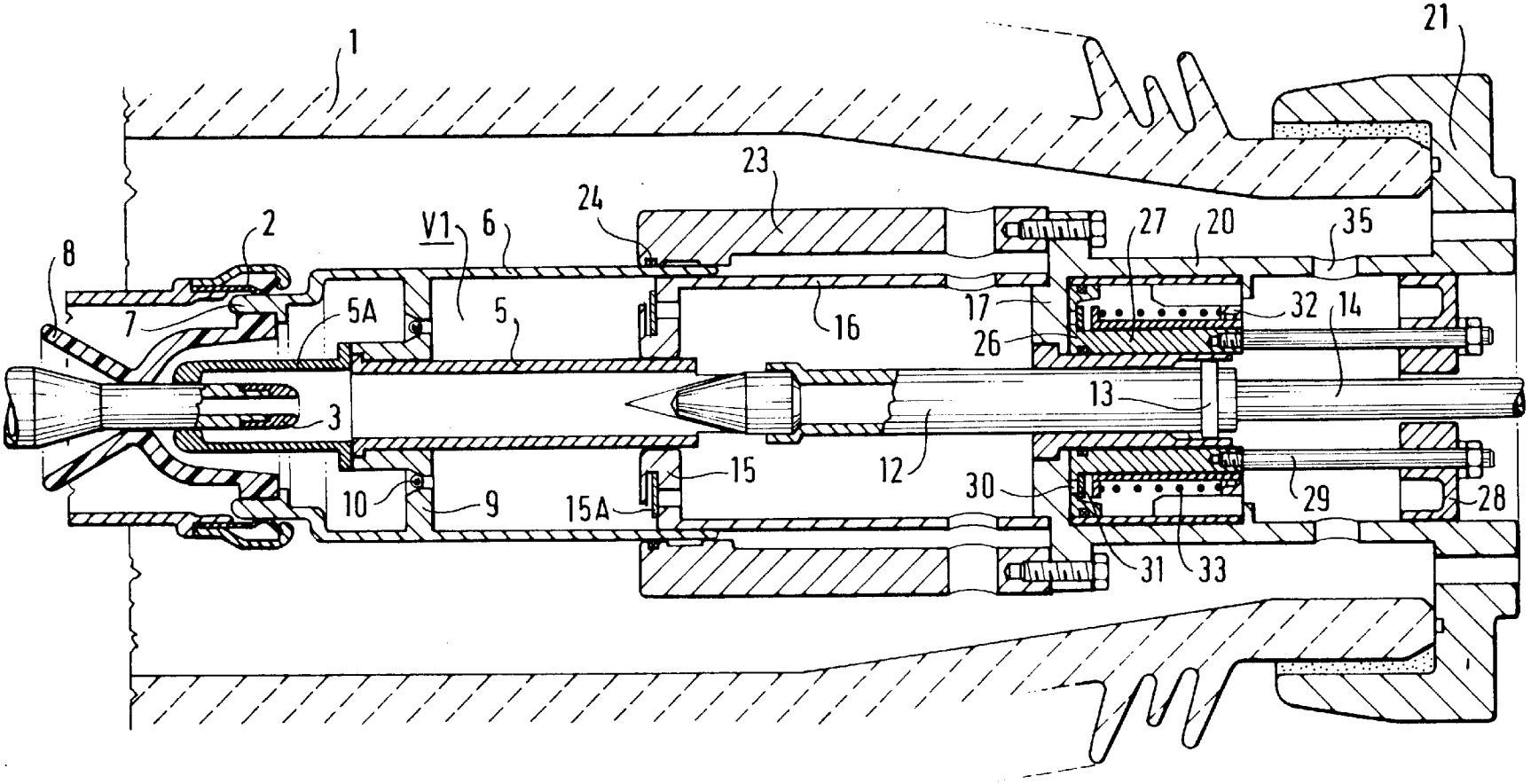
FIG. 1 is a fragmentary view in axial section of an interrupter chamber of a circuit-breaker shown in the set position.

The figures show only the part of the interrupter chamber in which the portions to which the invention relates can be seen. For a complete description of a high-tension circuit-breaker reference may be had to the article "Appareillage électrique d'interruption à haute tension", by Eugène MAURY, in "LES TECHNIQUES DE L'INGENIEUR" D 655 a.

The figures show a ceramic insulative jacket 1 filled with a gas having good dielectric properties such as sulfur hexafluoride at a pressure of a few thousand hectopascals.

On the lefthand side in the figures there is seen a fixed assembly comprising a main contact 2 and an arc contact 3 both of which are connected to a first terminal that cannot be seen in the figures.

On the righthand side in the figures there is seen a mobile assembly comprising:

- a metal tube 5 extended by an arc contact 5A cooperating with the contact 3,
- a metal tube 6 coaxial with and surrounding the tube 5, extended by a permanent contact 7 cooperating with the contact 2 and carrying a gas blast nozzle 8,
- a ring 9 fastening together the tubes 5 and 6 and provided with check valves 10.

The tube 5 is fixed to a tubular part 12 provided with an end ring 13; the tubular part 12 is connected to an insulative material operating rod 14 which is in turn actuated by an operating mechanism, not shown.

The interrupter chamber is completed by a fixed gas blast piston 15 provided with check valves 15A; the gas blast piston is extended by a cylindrical part 16 closed by an end wall 17 through which the tubular part 12 passes.

The gas blast piston 15, the cylindrical parts 5 and 6 and the ring 9 delimit a gas blast volume V1.

The end wall 17 is extended by a cylinder 20 connected to a metal flange 21 closing one end of the jacket 1 and carrying a second terminal, not shown.

The current passes from the contact 7 to the flange 21 via metal arms 23 provided with sliding contacts 24, of the concertina type, for example.

Figure 3:
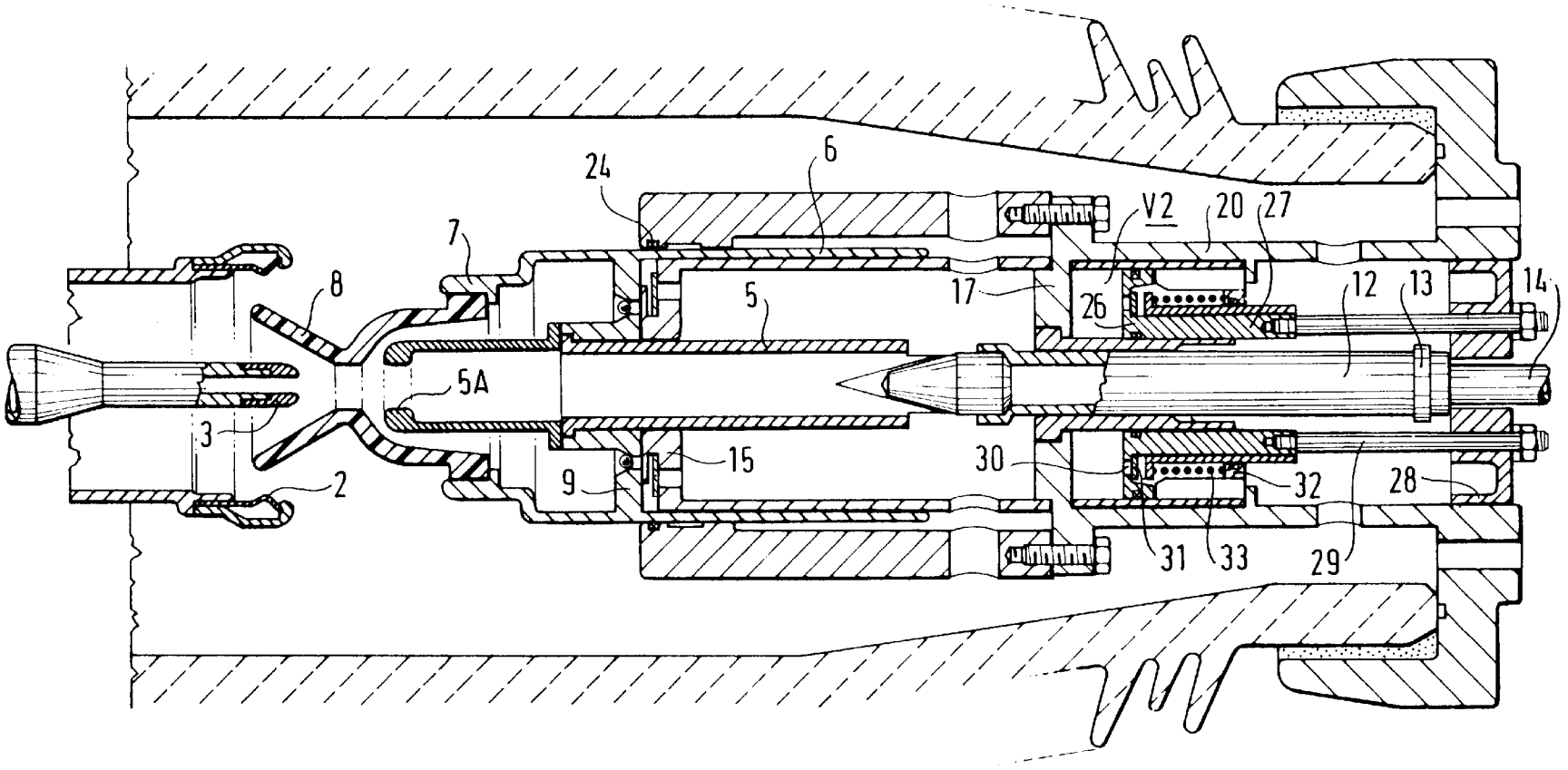
FIG. 3 is a similar view at the end of tripping.

The cylinder 20 and the tube 12 define an annular damper volume V2 that can be seen in FIG. 3 and in which a damper piston 26 slides. The piston rod of the damper piston comprises a cylindrical guide part 27 sliding on the tubular part 12. The part 27 is connected to a slider 28 by rods 29. The piston 26 incorporates calibrated holes 30 that can be closed off by a mobile washer 31 actuated by a spring, not shown, tending to maintain the holes closed. A spring 33 bearing on a fixed abutment 32 attached to the cylinder 20 urges the damper piston into abutment against the end wall 17.

Figure 2:
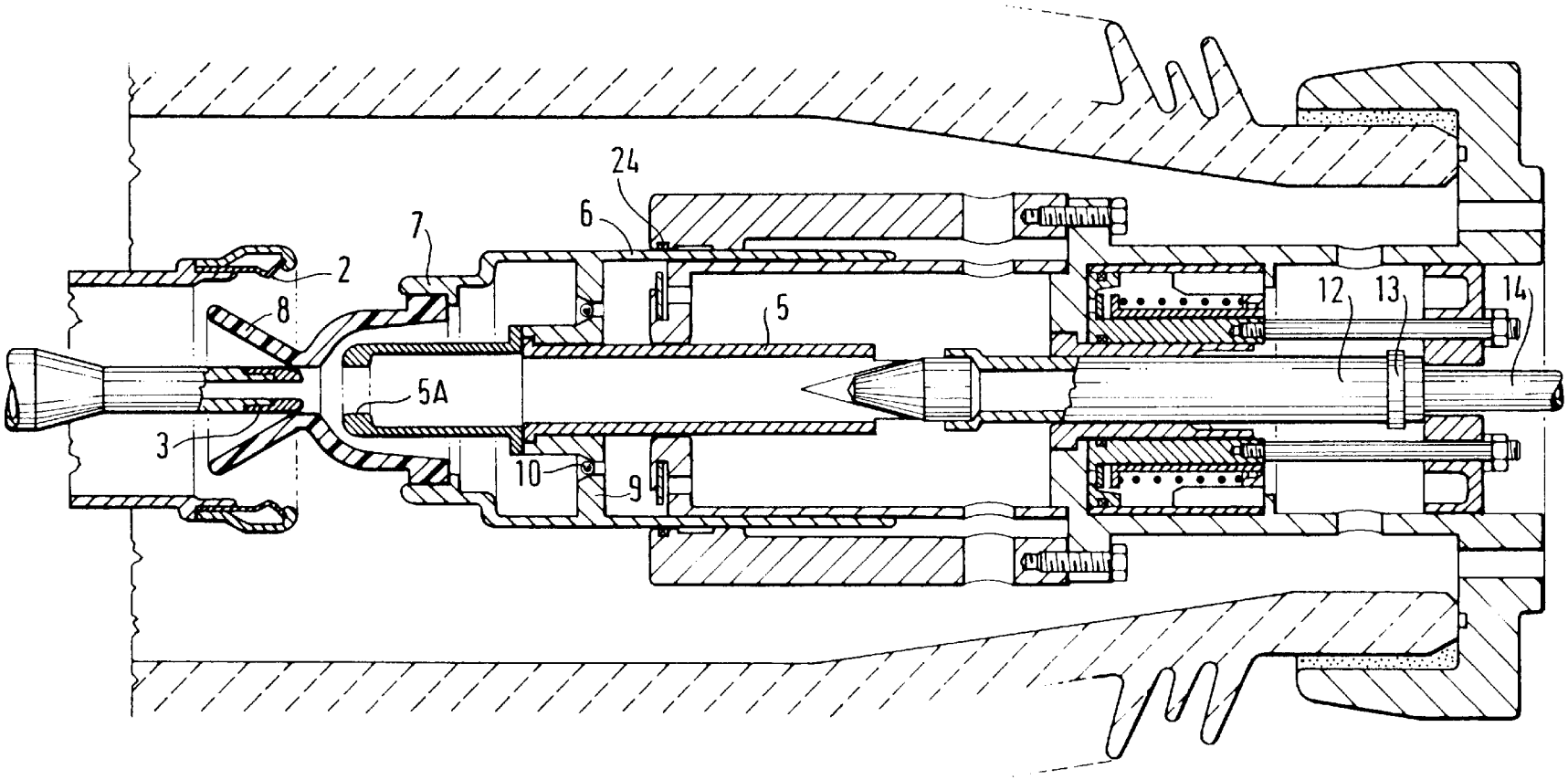
FIG. 2 is a similar view at the start of the tripping phase.

The circuit-breaker operates in the following manner:

- when the circuit-breaker is set, the piston 26 is abutted against the end wall 17.
- on tripping, the mobile assembly is moved by the translation movement of the operating rod 14 actuated by the operating mechanism. The contacts separate (FIG. 2) and the gas blown through the nozzle by the gas blast piston extinguishes the arc.
- at the end of the tripping maneuver (FIG. 3), the ring 13 entrains the slider 28 and consequently the piston 26. The latter creates a pressure drop behind it assuring good damping of the movement of the mobile assembly. Unlike damping created by compression, which procures a braking force that decreases as the movement progresses, damping created by a pressure drop procures a high force at the start of damping, assuring effective braking without risk of rebound, which is preferable.

The invention applies to conventional or metal-clad high-tension circuit-breakers.

There is claimed:

1. A high-tension circuit-breaker including fixed contacts and a mobile assembly including mobile contacts, said mobile assembly being connected to an operating mechanism by an operating rod, said circuit-breaker including a damper for damping movement of said rod at an end of a tripping maneuver, said damper including:

a tubular part provided with an end ring and disposed in a cylindrical part closed by an end wall, said tubular part being connected to said operating rod actuated by said operating mechanism;

a damper piston moving in a cylinder which extends said end wall and provided with a cylindrical guide part which slides on said tubular part, said cylindrical guide part being connected to a slider by rods;

wherein at the end of said tripping maneuver, said operating rod moves said tubular part such that said end ring entrains said slider and said slider entrains said damper piston, to move said damper piston in a direction away from said cylindrical part and said end wall such that a volume between said piston and said end wall increases during said maneuver, causing a pressure drop in said volume.

2. The circuit-breaker claimed in claim 1 wherein said damper piston uncovers holes establishing communication between said volume at a reduced pressure and a remainder of said mobile assembly at the end of said maneuver.

3. The circuit-breaker claimed in claim 1 wherein said damper piston compresses the volume between said damper piston and said end wall during said tripping maneuver.

* * * * *